US009911317B2

(12) United States Patent
Breed et al.

(10) Patent No.: US 9,911,317 B2
(45) **Date of Patent: *Mar. 6, 2018**

(54) METHOD AND SYSTEM FOR DETERMINING MAINTENANCE NEEDS AND VALIDATING THE INSTALLATION OF AN ALARM SYSTEM

(71) Applicant: TYCO SAFETY PRODUCTS CANADA LTD., Concord (CA)

(72) Inventors: Jason A. Breed, Richmond Hill (CA); Fahim Mirzazada, Mississauga (CA)

(73) Assignee: TYCO SAFETY PRODUCTS CANADA LTD., Concord, ON (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/206,897

(22) Filed: Jul. 11, 2016

(65) Prior Publication Data

US 2016/0335883 A1 Nov. 17, 2016

Related U.S. Application Data

(63) Continuation-in-part of application No. 14/495,970, filed on Sep. 25, 2014, now Pat. No. 9,390,616.

(60) Provisional application No. 61/886,251, filed on Oct. 3, 2013.

(51) Int. Cl.

| | |
|---|---|
| ***G08B 29/02*** | (2006.01) |
| ***G08B 29/18*** | (2006.01) |
| ***G08B 21/18*** | (2006.01) |
| ***G08B 29/12*** | (2006.01) |

(52) U.S. Cl.
CPC ..... *G08B 29/18* (2013.01); *G08B 21/182* (2013.01); *G08B 29/02* (2013.01); *G08B 29/12* (2013.01)

(58) Field of Classification Search
CPC ..... G08B 29/00; G08B 29/02; G08B 29/04; G08B 29/06; G08B 29/12; G08B 29/16; G08B 29/18; G08B 23/0283; G08B 21/18; G08B 21/182; G08B 21/185; A61B 6/58; A61B 6/581; A61B 6/586; A61B 8/58; A61B 8/582; A61B 8/585
See application file for complete search history.

(56) References Cited

U.S. PATENT DOCUMENTS

| | | | | |
|---|---|---|---|---|
| 6,453,279 | B1 | 9/2002 | Prasad et al. | |
| 7,525,420 | B2 | 4/2009 | McKinney | |
| 7,525,422 | B2 | 4/2009 | Bishop et al. | |
| 7,786,854 | B2 * | 8/2010 | Hosey | G08B 29/14 340/514 |
| 8,275,847 | B2 * | 9/2012 | Lewis | E02F 9/267 709/207 |
| 8,676,945 | B2 | 3/2014 | Adams, Jr. et al. | |
| 9,390,616 | B2 * | 7/2016 | Breed | G08B 29/00 |

(Continued)

*Primary Examiner* — Van Trieu

(57) ABSTRACT

A system and methods for determining maintenance needs of an alarm system are provided. The system may include a central monitoring station configured to receive operational measurements and apply maintenance rules to the operational measurements and a maintenance history for the alarm system to determine maintenance needs of the alarm system. Additionally, the central monitoring station may be configured to receive points, which may be modules or devices, and status updates and apply installation rules to the points and status updates to determine the maintenance needs for one or more of the points.

21 Claims, 4 Drawing Sheets

(56) References Cited

U.S. PATENT DOCUMENTS

| | | | | |
|---|---|---|---|---|
| 2002/0101345 | A1* | 8/2002 | Pattok | G08B 29/145<br>340/516 |
| 2003/0058093 | A1 | 3/2003 | Dohi et al. | |
| 2004/0217857 | A1 | 11/2004 | Lennartz et al. | |
| 2006/0233313 | A1 | 10/2006 | Adams et al. | |
| 2007/0241866 | A1 | 10/2007 | Cool et al. | |
| 2008/0084291 | A1 | 4/2008 | Campion et al. | |
| 2009/0306934 | A1 | 12/2009 | Gakhar et al. | |
| 2012/0290247 | A1 | 11/2012 | Smith | |
| 2013/0009782 | A1 | 1/2013 | Brandt et al. | |

* cited by examiner

METHOD AND SYSTEM FOR DETERMINING MAINTENANCE NEEDS AND VALIDATING THE INSTALLATION OF AN ALARM SYSTEM

CROSS-REFERENCE TO RELATED APPLICATION

This application is a continuation-in-part of U.S. patent application Ser. No. 14/495,970, filed Sep. 25, 2014, entitled "Method and Apparatus for Determining Maintenance Needs and Validating the Installation of an Alarm System," which claims priority to U.S. Provisional Patent Application No. 61/886,251, filed Oct. 3, 2013, entitled "Determining Maintenance Needs in a Security System," the entirety of which applications are incorporated herein by reference.

FIELD OF THE DISCLOSURE

The disclosure relates generally to the field of alarm systems, and more particularly to a system and method for determining the maintenance needs of an alarm system.

BACKGROUND OF THE DISCLOSURE

Alarm systems, such as fire alarm and security systems, typically include one or more alarm panels that receive information from various sensors distributed through a structured area. For example, a typical fire alarm system may include a plurality of initiating devices (e.g., smoke detectors, manually-actuated pull stations, etc.) and notification appliances (e.g., strobes, sirens, public announcement systems, etc.) operably connected to one or more alarm panels.

During normal operation of the alarm system, the alarm panel may monitor electrical signals associated with each of the initiating devices for variations that may represent the occurrence of an alarm condition. For example, a variation in a particular electrical signal may represent the detection of smoke by a smoke detector in a corresponding area, or "zone," of a structure in which the smoke detector is located, and may cause the alarm panel to enter an alarm mode. The alarm panel may be configured to respond to such a condition by initiating certain predefined actions, such as activating one or more of the notification appliances within the monitored structure and/or notifying an external monitoring company.

In order to ensure proper operation, various components of the alarm system may need periodic maintenance. For example, some points of the alarm system may periodically require replacement batteries. As another example, some points may need their wireless connectivity updated. Some alarm systems include the ability to alert an operator and/or an external monitoring company that components of the alarm system need maintenance. In response to this alert, a technician may be dispatched to resolve the maintenance issue. For example, in response to an alert that a point has low batteries, a technician may be dispatched to replace the batteries. This does not prevent a second maintenance alert being triggered shortly after the technician resolves the initial maintenance issue. As such, multiple visits by a technician may be necessitated in a short period of time. This increases costs associated with maintaining the alarm system.

One solution to this problem is for a technician to perform all possible maintenance at each site visit as a precaution against future maintenance alerts. For example, a technician may replace the batteries in all the points of the alarm system each time the technician visits the site. However, this may result in unnecessary maintenance costs and is an inefficient use of resources. It is with respect to these and other considerations that the present improvements are needed.

SUMMARY

In view of the forgoing, a system and methods for determining maintenance needs and validating the installation of an alarm system are provided. The system may include a central monitoring station configured to receive operational measurements and apply maintenance rules to the operational measurements and a maintenance history for the alarm system to determine maintenance needs of the alarm system. Additionally, the central monitoring station may be configured to receive status updates and points, which may be modules or devices, and apply installation rules to the status updates and the points to determine the maintenance needs for one or more of the points.

An exemplary embodiment of a method for determining maintenance needs in an alarm system may include receiving, at a central monitoring station, a plurality of operational measurements and a maintenance history related to the alarm system, and predicting a maintenance need of the alarm system by applying one or more maintenance rules to the plurality of operational measurements and the maintenance history.

Another exemplary embodiment of a method for determining maintenance needs in a security system may include receiving, at a central monitoring station, a plurality of operational measurements and a maintenance history related to a plurality of points of the security system, and predicting a maintenance need of the plurality of points by applying one or more maintenance rules to the plurality of operational measurements and the maintenance history.

An exemplary system for determining maintenance needs of an alarm system may include a connection component configured to receive a plurality of operational measurements from a plurality of points of an alarm system, and a maintenance needs determination module configured to predict a maintenance need of the plurality of points by applying one or more maintenance rules to the plurality of operational measurements and the maintenance history.

BRIEF DESCRIPTION OF THE DRAWINGS

By way of example, specific embodiments of the disclosed device will now be described, with reference to the accompanying drawings, in which.

DETAILED DESCRIPTION

Figure 1:
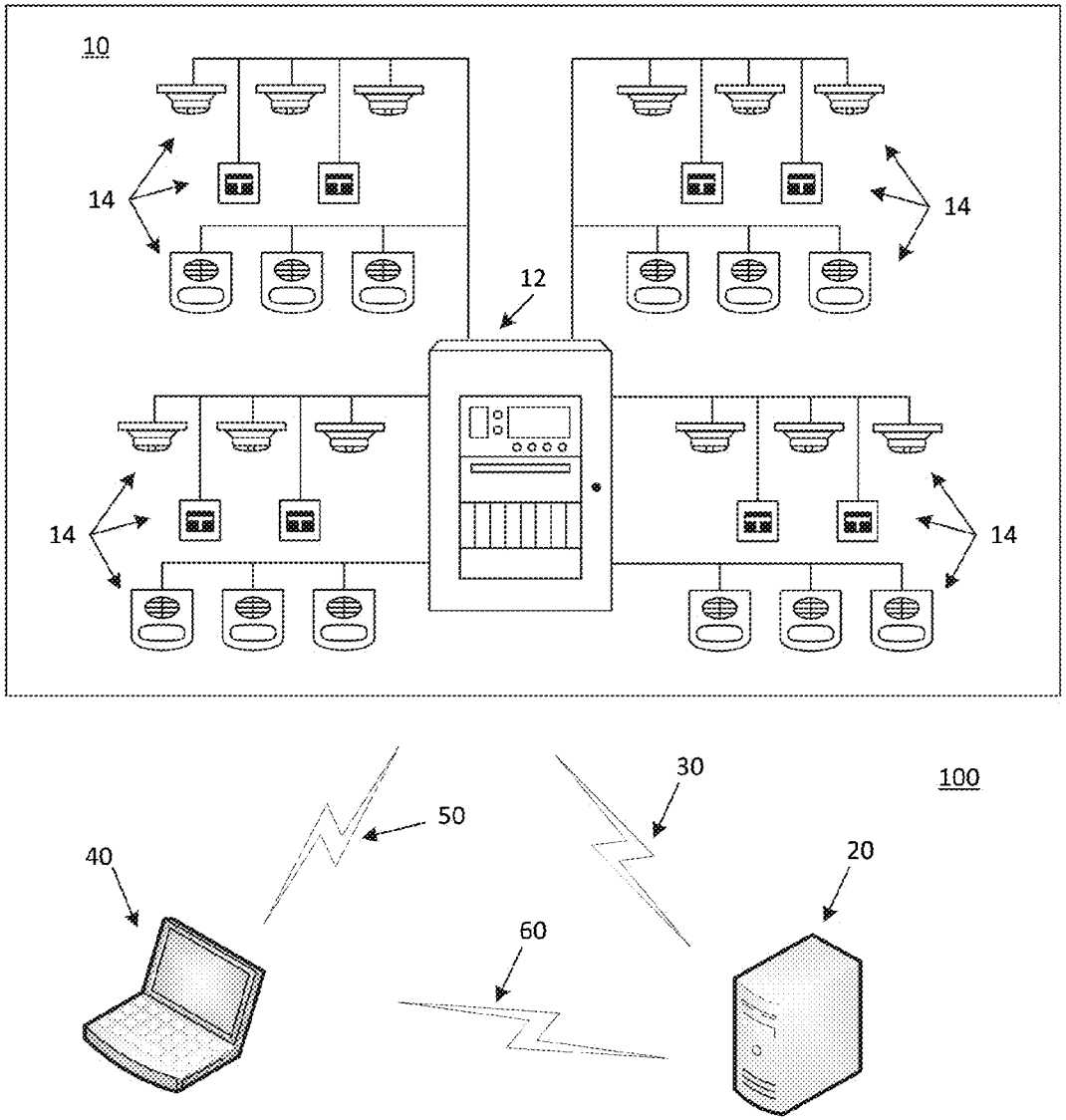
FIG. 1 is a block diagram illustrating an alarm system maintenance determination and installation validation system in accordance with the present disclosure.

As discussed above, various inefficiencies exist in servicing the ongoing maintenance needs of an alarm system. To this end, a system and method for determining the maintenance needs in an alarm system in accordance with the present disclosure will now be described more fully hereinafter with reference to the accompanying drawings. In some examples, the systems and methods may be used at the time an alarm system is installed (or serviced) to validate an installation (or configuration) of the alarm system. With some examples, the systems and methods may be used to determine maintenance operations to perform on the alarm system to provide for a reduction in the number of service visits needed and/or a reduction in the overall costs associated with maintaining the alarm system.

Furthermore, these disclosed systems and methods may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the alarm system maintenance needs determination and installation validation systems and methods described herein may be implemented for virtually any type of alarm, monitoring, or control system, including, but not limited to, fire alarm systems, intrusion alarm systems, surveillance systems, air quality monitoring systems, inventory monitoring systems, etc., or any combination thereof, such as may be provided for detecting an alarm event (e.g., a security breach) or a warning condition (e.g., an elevated temperature) in a building, structure, enclosure, or area (collectively referred to herein as "sites"). Many other applications are contemplated and may be implemented without departing from the scope of the present disclosure. All such applications are collectively referred to herein as "alarm systems."

A first exemplary alarm system maintenance needs determining and installation validation system (hereinafter "system") in accordance with the present disclosure is depicted in FIG. 1. The disclosed system 100 may include an alarm system 10 installed at a monitored site. The alarm system 10 may include an alarm panel 12 operably connected to a number of points 14 (e.g., initiating devices and/or notification appliances). Furthermore, the alarm system 10 may be communicatively coupled to a central monitoring station 20 via connection 30. In general, the central monitoring station 20 may be a server at a remote location. It is to be appreciated, however, that the central monitoring station 20 may be a single computing device or may be multiple computing devices. For convenience, however the central monitoring station 20 is referred to as a single device.

It will be appreciated that although portions of the disclosure will proceed mainly in relation to a fire alarm system, the disclosure is not limited to fire alarm applications. Thus, the disclosed system 100 may also find application in any of a variety of alarm and monitoring applications such as building automation systems and security systems. Moreover, the predictive maintenance aspects of the disclosure can be applied to virtually any component ("point" 14) of such systems. In the context of the disclosed system 100, a point 14 may be any kind of module or device connected to the alarm system, an exemplary, non-limiting list of which can include initiating devices, notification appliances, video and/or audio recording devices (e.g., security cameras), zone expanders, output modules, power supplies, light controllers, appliance controllers, sounding devices, thermostats, intrusion glass break sensors, controllable outlets, door locks, door/window contacts, flood sensors, motion detectors, toxic gas detectors, power monitors, vents, remotes, water valves, vents, baffles, and the like.

During operation of the alarm system 10, various maintenance needs may arise. The central monitoring station 20 may be configured to determine what maintenance operations to perform to reduce the number of times the alarm system 10 requires maintenance. It is to be appreciated, that the present disclosure can be implemented to both determine when maintenance needs arise, or will arise, as well as to determine "preventative" maintenance operations. More specifically, the present disclosure can be implemented to monitor and periodically suggest maintenance operations to perform to an alarm system such that critical maintenance conditions are avoided or "prevented."

For example, some maintenance operations require a technician to be dispatched to the alarm system site to perform the maintenance. The central monitoring station 20 may be configured to determine which maintenance operations to perform to reduce the probability that a technician will need to be repeatedly dispatched. As another example, the present disclosure may be implemented to suggest to an operator (e.g., via notification on the panel 12, or the like) various maintenance operations to perform to obviate the needs for a technician service call. In some embodiments, this can be coupled with a service agreement wherein consumable maintenance items (i.e., batteries, filters, replaceable sensors, or the like) are automatically shipped to a customer's location based on the maintenance needs determination described herein.

Additionally, the central monitoring station 20 may be configured to validate the installation (or configuration) of the alarm system 10 to reduce the probability of future maintenance needs of the system. As will be appreciated, during installation of the alarm system 10, a technician may place the points 14 throughout the site to be monitored by the alarm system 10. Furthermore, the technician may configure the alarm panel 12 to recognize the points 14. This may include organizing the points 14 into different zones, configuring the behavior of the alarm panel 12 in response to signals received from the points 14, and configuring a connection 30 between the alarm panel 12 and the central monitoring station 20.

In order to aid in the installation, the technician may utilize a computing device 40. The computing device 40 may be a portable computing device (e.g., a laptop computer, a tablet computer, a smart phone, or the like) that may be communicatively coupled to the alarm panel 12 via connection 50 and to the central monitoring station 20 via connection 60. The technician may use the computing device 40 to configure the alarm panel 12 during an initial installation and to update the configuration of the alarm panel 12 (e.g., at a maintenance visit, or the like). It is to be appreciated, that the installation validation methods discussed herein may be used at either an initial installation or at a subsequent site visit. The uses of the term "installation validation," "validate an install" or other such terms shall not be construed as applying only to the first time that an alarm panel and associated points are placed and/or configured. For example, with some embodiments, the installation of the alarm system may be validated at the time of install, and/or at the time maintenance is performed on the alarm system.

In general, the connections 30, 50, and 60 may be any type of data communication connection configured to allow signals to be transmitted between the alarm panel 12, the central monitoring station 20, and the computing device 40. It is important to note, that although the connections 30, 50, and 60 are depicted as wireless connections, the connections may be wireless or may be wired. Furthermore, with some examples, the connections 30, 50, and/or 60 may be routed through a network (e.g., a TCP/IP network, a cellular network, a packet switched network, the Internet, or the like). Additionally, the connections 30, 50, and 60 may not be the same type of connection. For example, the connection 30 may be a cellular telephone connection, the connection 50 may be a universal serial bus connection, and the connection 60 may be a connection routed through the Internet.

Example embodiments of the alarm panel 12, the central monitoring station 20, and the computing device 40 will now be described more fully with reference to FIGS. 2-4. Their operation, and example methods for determining maintenance needs and validating the installation of an alarm system will be described with reference to FIGS. 5-6.

Figure 2:
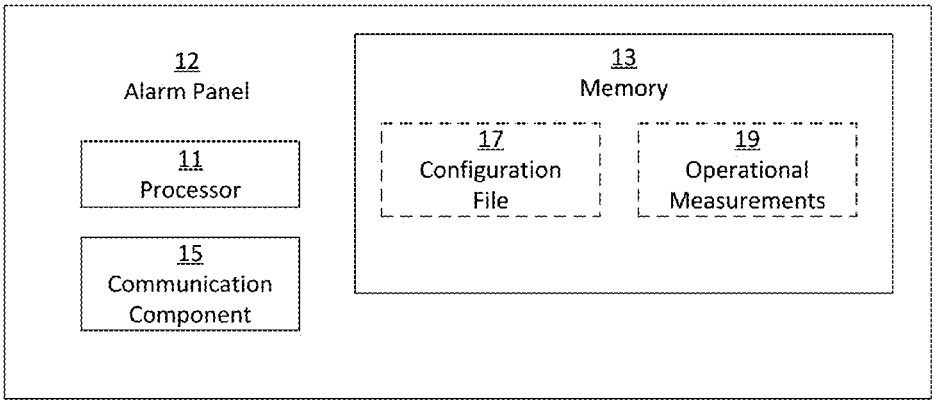
FIGS. 2-4 are block diagrams illustrating portions of the system shown in FIG. 1 is greater detail, all arranged in accordance with the present disclosure.

Turning now to FIG. 2, the alarm panel 12 may include a processor 11, a memory 13, and a communication component 15. The processor 11 can be any microprocessor configured to execute a set of instructions, which when executed, cause the alarm panel 12 to perform a set of actions defined by the instructions. The memory 13 may be any type of computer-readable medium, including non-transient computer-readable medium, such as, for example, EPROM, EEPROM, ROM, FLASH, magnetic storage media, or the like. The communication component 15 may be any device and/or module configured to establish communication with the central monitoring station 20 and/or the computing device 40. The communication component 15 may be configured to establish a wireless or a wired communication link with the central monitoring station 20 for purposes of transmitting data (e.g., a operational measurements) from the alarm panel 12 to the central monitoring station 20. Additionally, the communication component 15 may be configured to establish a wireless or a wired communication link with the computing device 40 for purposes of configuring and/or performing maintenance on the alarm system 10.

In some examples, the communication component 15 may be a network interface component (e.g., an Ethernet port, a WIFI radio, a Cellular data radio, or the like). In some examples, the communication component 15 may be a packet switched network component (e.g., a telephone modem, a DSL modem, or the like).

The memory 13 of the alarm panel 12 stores a configuration file 17, which may be used by the alarm panel 12 during operation. In general, the configuration file 17 indicates the points 14 that are connected to the alarm panel, their type, their status (e.g., active, inactive, or the like), their function, alarm conditions, actions to take if alarm conditions are detected, etc. The configuration file 17 is encoded into a format readable by the alarm panel 12, and is therefore not necessarily human-readable. The format may differ depending upon the type of alarm panel, the manufacturer of the alarm panel, the model of the alarm panel, etc.

During operation of the alarm system 10, the alarm panel 12 records various quantitative measurements and stores them in the memory 13 as operational measurements 19. As an example, the operational measurements 19 may include measurements of the battery level of one or more points 14. As another example, the operational measurements 19 may include measurements of the wireless connectivity level of one or more of the points 14. As another example, the operational measurement 19 may include a measurement of the cellular connectivity level of the alarm panel 12 or one or more points 14. As another example, the operational measurements 19 may include a measurement of the resistance of connections between various points 14 or at one or more points 14. As another example, the operational measurements 19 may include a measurement of the power consumption of the alarm panel 12 or of one or more points 14. In other examples, the operational measurements 19 may include measures of temperature, vibration, humidity, carbon monoxide, smoke compensation, or the like, in an environment (e.g., at the site) surrounding one or more points 14. As another example, the operational measurements 19 may include fluid characteristics of one or more points 14.

It will be appreciated that in accordance with the disclosure, such operational measurements may be used to predict when system maintenance is desirable. Thus, the operational measurements can be employed as part of a predictive model for the associated system components, and the operational trending observed from the disclosed measurements can be used to enable maintenance to be performed before a component fails or otherwise requires repair or replacement. A series of non-limiting examples will now be provided to illustrate the types of operational measurements that can be obtained in relation to exemplary system components. As will be appreciated, numerous other types of operational measurements, and other system component types, are contemplated.

More specifically, as an example, the operational measurements 19 for a zone expander may include a resistance measurement which can be tracked over time to indicate, for example, a crimp or other defect in the wire if a resistance drift is observed. As another example, the operational measurements 19 for an output module (e.g., one that may support the power requirements of a lighting element or other powered device), may be at least one of current and voltage levels, in which change/drift over time may indicate module degradation or that a new device is connected and drawing power from the system. As another example, the operational measurements 19 for a power supply, such as a battery, could be any indicator measuring health and/or capacity. Where the power supply is a rechargeable power supply (i.e., a battery), the operational measurements 19 may include a speed at which the rechargeable power supply is accepting a charge, and can also or alternatively include the length of time the rechargeable power supply holds a charge above a predetermined level. As another example, the operational measurements 19 for light or appliance controllers could be an indication that the associated lighting element or other powered device is drawing current that is a predefined amount higher or lower (e.g., on a percentage basis) than a predetermined value. Such changes may indicate a fault in the controller or the associated lighting element or other powered device, or they may indicate that the user has attached an additional or different device to the controller. As another example, the operational measurements 19 for a thermostat may be an indication of how quickly the home is being heated/cooled, which may indicate that a component of the heating/cooling system is malfunctioning (e.g., a filter should be replaced, coolant charge levels are low), or that an aspect of the heated/cooled space has changed. Such values can be compared to temperatures external to the space to determine how external factors may be affecting system operation. As another example, the operational measurements 19 for a power monitor may include an indication of how much current a device is drawing compared to previously observed values, which may indicate that the device is approaching the end of its life span and requires replacement. As another example, the operational measurements 19 for a water, gas or other valve may include a flowrate measurement, where a decrease in flow might indicate a leak in the system, or a fault in the valve. As another example, the operational measurements 19 for a vent, such as a heating and/or cooling vent or baffle, may include an observed change in air flow, which may indicate that the vent or baffle is blocked and that an aspect of the system requires cleaning.

The alarm panel 12 may communicate the operational measurements 19 (e.g., in real time, periodically, in groups, or the like) to the central monitoring station 20 for purposes of the central monitoring station determining the maintenance needs and validating the installation of the alarm system 10. This will be explained in greater detail below. However, a brief example is provided here for clarity. The alarm system 10 may be configured to monitor pressure in, for example, a tire, a vessel, a tank, a storage container, or the like. During operation, the alarm panel 12 may record various quantitate measurements of the pressure inside the monitored vessel. Such measurements may be periodically transmitted to the central monitoring station 20. The central monitoring station 20 may use the operational measurement to "predict" future pressure conditions. For example, if the pressure is continually declining, the central monitoring station 20 may determine that a leak exists even if the pressure has not fallen below a critical level.

Figure 3:
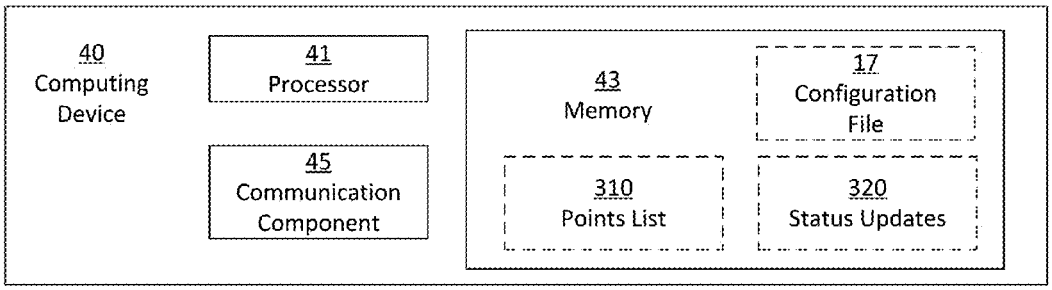

Turning now to FIG. 3, the computing device 40 includes a processor 41, a memory 43, and a communication component 45. The processor 41 can be any microprocessor configured to execute a set of instructions, which when executed, cause the computing device 40 to perform a set of actions defined by the instructions. The memory 43 may be any type of computer-readable medium, including non-transient computer-readable medium, such as, for example, EPROM, EEPROM, ROM, FLASH, magnetic storage media, or the like.

The communication component 45 may be any device and/or module configured to establish communication with the alarm panel 12 and/or the central monitoring station 20. In general, the communication component 45 may be configured to establish a wireless or a wired communication link with the alarm panel 12 for purposes of configuring the alarm panel, updating the configuration of the alarm panel, or performing maintenance on the alarm panel. Additionally, the communication component 45 may be configured to establish a wireless or a wired communication link with the central monitoring station 20 for purposes of transmitting data (e.g., points, status updates, or the like) from the computing device 40 to the central monitoring station 20. In some examples, the communication component 15 may be a network interface component (e.g., an Ethernet port, a WIFI radio, a Cellular radio, or the like).

The memory 43 of the computing device 40 stores points list 310, status updates 320, and/or configuration file 17. The points list 310 may correspond to the points 14 installed in the alarm system 10. The status updates 320 may include various characteristics of the points 14 represented in the points list 310. In general, the status updates may include any quantitative data regarding the measurements from a device in the system, as well as the detailed information (e.g., the firmware, software, hardware, or the like) about the device. In some examples, the points list 310 may include a model identification corresponding to the points 14 represented in the points list 310. Additionally, the status updates 320 may include status updates corresponding to the points 14. For example, the status updates 320 may include measurements of the battery level of one or more points 14. As another example, the status updates 320 may include measurements of the wireless connectivity level of one or more of the points 14. As another example, the status updates 320 may include a measurement of the cellular connectivity level of the alarm panel 12. As another example, the status updates 320 may include a measurement of the resistance of connections between various points 14. As another example, the status updates 320 may include a measurement of the power consumption of the alarm panel 12 or one or more points 14. As another example, the status updates 320 may include a measurement of the cellular connectivity level of the alarm panel 12 or one or more points 14. As another example, the status updates 320 may include a measurement of the resistance of connections between various points 14 or at one or more points 14. As another example, the status updates 320 may include a measurement of the power consumption of the alarm panel 12 or of one or more points 14. In other examples, the status updates 320 may include measures of temperature, vibration, humidity, carbon monoxide, smoke compensation, or the like, at one or more points 14 or in an environment (e.g., at the site) near one or more points 14. As another example, the status updates 320 may include fluid characteristics of one or more points 14.

The points list 310 and the status updates 320 may be communicated to the central monitoring station 20 during an initial installation, configuration, or maintenance operation of the alarm system 10 for purposes of the central monitoring station 20 determining the maintenance needs and validating the installation of the alarm system 10. This will be explained in greater detail below.

Figure 4:
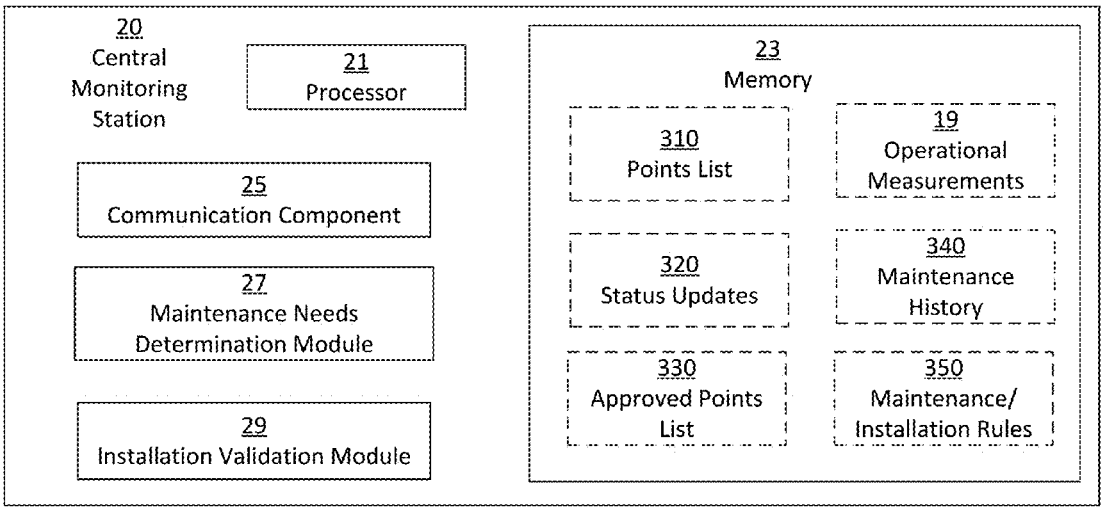

Turning now to FIG. 4, the central monitoring station 20 includes a processor 21, a memory 23, a communication component 25, a maintenance needs determination module 27, and an installation validation module 29. The processor 21 can be any microprocessor configured to execute a set of instructions, which when executed, cause the central monitoring station 20 to perform a set of actions defined by the instructions. Furthermore, the memory 23 may be any type of computer-readable medium, including non-transient computer-readable medium, such as, for example, EPROM, EEPROM, ROM, FLASH, magnetic storage media, or the like.

The communication component 25 enables the central monitoring station 20 to connect to the alarm panel 12 (e.g., via connection 30) and to the computing device 40 (e.g., via the connection 50) for purposes of determining maintenance needs and validating the installation of the alarm system 10. In some examples, the communication component may be an Ethernet port, or the like, thus enabling the central monitoring station 20 to be accessible via the Internet.

The memory 23 of the central monitoring station 20 stores the operational measurements 19, the points list 310, and the status updates 320. As described above, these may be received from the alarm panel 12 and/or the computing device 40 during operation of the alarm system 10 and/or during installation, configuration, or maintenance of the alarm system 10. Additionally, the memory 23 stores an approved points list 330, a maintenance history 340, and maintenance and installation rules 350.

The approved points list 330 may include a listing of points 14 that are approved. More particularly, the approved points list 330 may include a listing of points (e.g., type, manufacturer, model number, or the like) that are approved for installation in the alarm system 10. With some examples, a monitoring company responsible for maintenance of the alarm system 10 may provide the approved points list. As another example, the approved points list may correspond to points preferred by alarm system monitoring agencies. For example, some alarm systems are installed and then contracts to monitor, service, and/or maintain the alarm system are sold. As such, the approved points list may be provided to ensure that the alarm system 10 is installed according to desired standards.

The maintenance history 340 may include maintenance operations performed on the alarm system 10. In some examples, the maintenance history 340 may include a listing of the maintenance operations performed on the alarm system 10 and the corresponding dates at which the maintenance operations were performed. Additionally, the maintenance history 340 may include information from the operational measurements 19. More specifically, the maintenance history 340 may be a historical database including information related to the overall operation (e.g., maintenance, performance, or the like) of the alarm system 10. The maintenance history 340 may be provided to determine maintenance needs of the alarm system 10.

The maintenance and installation rules 350 may include a variety of rules related to making determinations about maintenance needs and installation of the alarm system 10. It is to be appreciated, that a variety of rule based decision making techniques may be employed, and as such, the maintenance and installation rules 350 may be embodied in a variety of different rule types (e.g., decision tree, many-valued logic, fuzzy logic, or the like). The maintenance and installation rules 350 may be provided to determine the maintenance needs and validate the installation of the alarm system 10.

In general, the central monitoring station 20 provides for determining the maintenance needs of the alarm system 10 and for validating the installation of the alarm system 10. With some examples, the maintenance needs determination module 27, may cause the central monitoring station 20 (e.g., by causing the processor 21 to execute instructions, or the like) to determine maintenance operations for the alarm system 10. With some examples, the maintenance needs determination module 27 may execute automatically (e.g., at a specified time period, upon receipt of an alert, or the like). With some examples, the maintenance needs determination module 27 may be executed manually (e.g., at the request of a technician, at the request of an operator of the alarm system 10, or the like).

In general, the maintenance needs determination module 27 may determine a maintenance need of the alarm system based at least in part on the plurality of operational measurements 19 and the maintenance history 340, and the maintenance and installation rules 350. For example, the maintenance needs determination module 27 may apply the maintenance and installation rules 350 to the maintenance history 340 and the operational measurements 19 to determine one or more maintenance operations.

With some examples, the maintenance needs determination module 27 may, by applying the maintenance and installation rules 350 to the maintenance history 340 and the operational measurements 19, determine required maintenance needs and/or imminent maintenance needs of one or more points 14. For example, the maintenance needs determination module 27 may determine maintenance needs that may arise within a specified period of time (e.g., 3 months, 6 months, annually, or the like). This determined maintenance needs may be used to perform maintenance in a single site visit as a precaution against repeated site visits within the specified period of time.

With some examples, the maintenance needs determination module 27 may determine required (e.g., necessary for continued operation, or the like) maintenance needs of the alarm system 10 as well as one or more suggested (e.g., optional for improved performance, or the like) maintenance needs of the alarm system 10. For example, the maintenance needs determination module 27 may determine (e.g., based on model identifications of the points list 310, or the like) that various ones of the points 14 may be upgraded (e.g., newer, different manufacturer, different model, or the like). In one embodiment, the maintenance needs determination module 27 may determine the maintenance need is a software or firmware update for one or more points 14. Such predictive maintenance may include identifying software and/or firmware upgrades, wherein the maintenance need is obtaining new software or updating existing software, and then identifying whether the newer version is implemented. Furthermore, in some embodiments, the maintenance needs determination module 27 may identify a priority of implementation (e.g., a required update v. an optional update), including an order in which multiple updates should be applied to one or more points 14.

In another embodiment, the maintenance needs determination module 27 may determine the maintenance need is a suggested replacement for one or more points 14. Such suggested maintenance needs may be presented to the alarm system operator as services that may be performed at the same time as the site visit to perform the required maintenance operations.

In general, the installation validation module 29 may validate the installation of the alarm system 10 based at least in part on the points list 310, the status updates 320, the approved points list 330, and the maintenance and installation rules 350. For example, the installation validation module 29 may apply the maintenance and installation rules 350 to the points list, the status updates 320, and the approved points list 330 determine whether the alarm system 10 is installed to a specified standard. With some examples, the installation validation module 29 may generate (e.g., display, print, email, or the like) a pass/fail report listing the criteria used to determine whether the installation of the alarm system 10 is validated.

Figure 5:
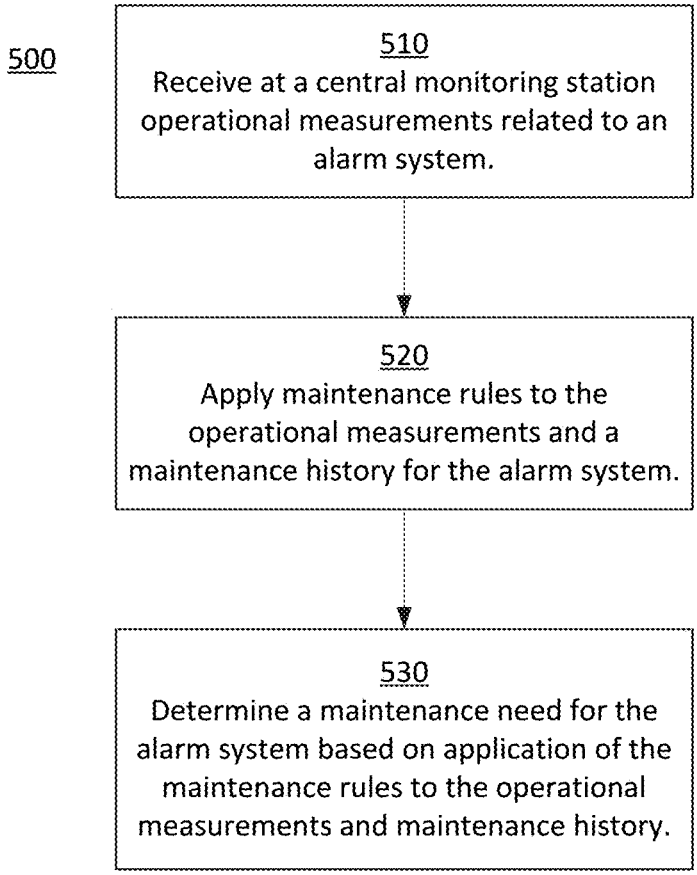
FIGS. 5-6 are flow diagrams illustrating exemplary methods for determining maintenance needs and validating the installation of an alarm system in accordance with the present disclosure.

Referring now to FIG. 5, a flow diagram illustrating an exemplary method 500 for determining maintenance needs of an alarm system in accordance with the present disclosure is shown. At a first block 510 of the method 500, a central monitoring station may receive operational measurements related to points of an alarm system. For example, at block 510, the central monitoring station 20 may receive the operational measurements 19 from the alarm panel 12.

Continuing from block 510 to block 520, maintenance rules are applied to the operational measurements and a maintenance history for the plurality of points of the alarm system. For example, at block 520, the maintenance needs determination module 27 may apply the maintenance and installation rules 350 to the operational measurements 19 and the maintenance history 340.

Continuing from block 520 to block 530, a maintenance need for the alarm system is determined based on application of the maintenance rules to the operational measurements and the maintenance history. For example, at block 530, the maintenance needs determination module 27 may determine maintenance needs of the alarm system 10 based application of the maintenance and installation rules 350 to the operational measurements 19 and the maintenance history 340.

Figure 6:
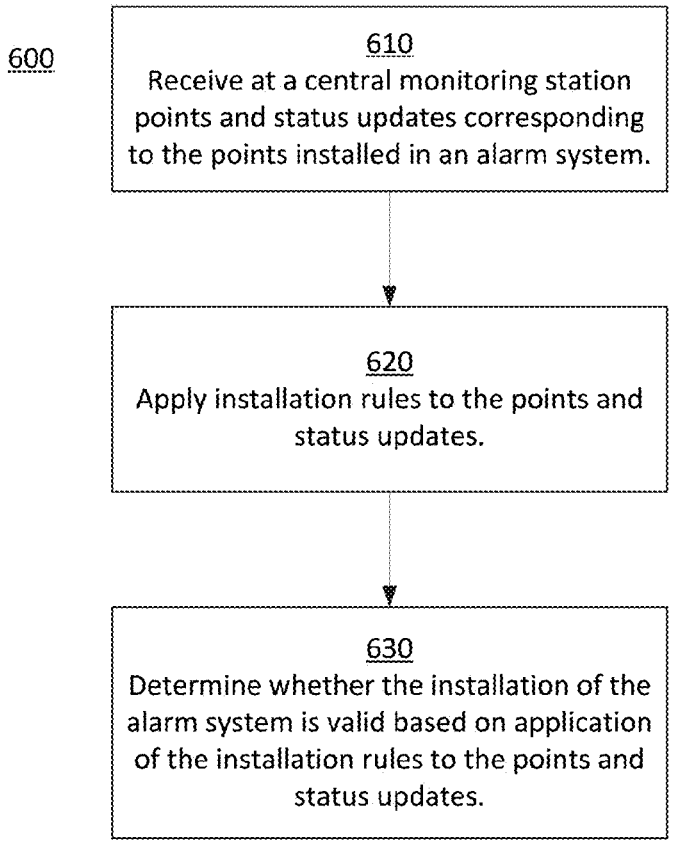

Referring now to FIG. 6, a flow diagram illustrating an exemplary method 600 for validating the installation of an alarm system in accordance with the present disclosure is shown. At a first block 610 of the method, a central monitoring station may receive points and status updates corresponding to the alarm system. For example, at block 610, the central monitoring stations 20 may receive the points list 310 and the status updates 320.

Continuing from block 610 to block 620, installation rules are applied to the points and status updates. For example, at block 620, the installation validation module 29 may apply the maintenance and installation rules 350 to the points list 310 and the status updates 320.

Continuing from block 620 to block 630, the validity of the installation is determined based on the application of the installation rules to the points and the status updates. For example, at block 630, the installation validation module 29 may determine whether the installation of the alarm system 10 is valid based on the application of the maintenance and installation rules 350 to the points list 310 and the status updates 320. A test signal may be sent to the alarm system 10 and the received response from the alarm system to the test signal may be used to determine whether the installation of the alarm system 10 is valid.

Thus, systems and method for determining maintenance needs and validating the installation of an alarm system have been described. It is to be appreciated, that a variety of different example implementations of the above described systems and methods may exist. These various examples may depend upon the particular alarm system, the monitoring service, the operator the alarm system, or other conditions and standards. The following illustrative examples, however, are given for purposes of completeness and clarity, but are not intended to be limiting. These examples reference the above system 100 in order to further illustrate example implementations for the above described systems and methods.

In one illustrative example, the alarm system 10 may include a variety of points 14, one of which may be a video recording device (e.g., camera) for monitoring an area of interest. The alarm panel 12 may communicate an operational alert to the central monitoring station 20 indicating that software and/or firmware for the video recording device is out of date. The maintenance needs determination module 27 may apply the maintenance and installation rules 350 to the operational measurements 19 and the maintenance history 340 to determine the version of software/firmware present on the video recording device, as well as a history of previous updates performed. The maintenance needs determination module 27 may then report to the video recording device the requirement to update the software/firmware.

In another illustrative example, the alarm system 10 may include a variety of wireless points 14. The alarm panel 12 may communicate an operational alert to the central monitoring station 20 indicating that one of the wireless points 14 has a low battery. The maintenance needs determination module 27 may apply the maintenance and installation rules 350 to the operational measurements 19 and the maintenance history 340 to determine the battery levels for each of the wireless points 14 and determines based on historical battery levels indicated in the maintenance history 340 and/or the operational measurements 19 which other ones of the wireless points will have a low battery within a specified time period (e.g., six months, or the like). The maintenance needs determination module 27 may then report that the point 14 with the low battery as well as the other points identified to have low batteries within the specified time period should be services at the same time.

In a further illustrative example, the installation of the alarm system 10 may be validated when the batteries in the wireless points 14 are replaced. The computing device 40 may communicate the points list 310 and the status updates 320 to the central monitoring station. The points list 310 may include a listing of wireless points 14 as well as the indication of the model identification of the alarm panel 12. The status updates 320 may indicate the cellular connectivity of the alarm panel 12 to a cellular network and the wireless connectivity of the points 14 to the alarm panel 12. The installation validation module 29 may apply the maintenance and installation rules 350 to the points list 310 and the status updates 320 to determine whether the wireless connectivity of all points 14 are above a specified level, whether the cellular connectivity of the alarm panel 12 is above a specified level, and whether the alarm panel model identification is listed as approved in the approved points list 330. If the wireless connectivity levels and the cellular connectivity level are above the specified levels and the alarm panel 12 is an approved model, the installation validation module 29 may generate a report indicating that the alarm system installation is valid.

As noted, the above illustrative examples are given for clarity and completeness only. It is to be appreciated, that the maintenance and installation rules 350, and as such, the criteria for determining maintenance needs and installation validity may vary. As such, other implementations and examples not disclosed herein are possible without departing from the sprit and scope of the claimed subject matter.

As used herein, an element or step recited in the singular and proceeded with the word "a" or "an" should be understood as not excluding plural elements or steps, unless such exclusion is explicitly recited. Furthermore, references to "one embodiment" are not intended to be interpreted as excluding the existence of additional embodiments that also incorporate the recited features.

The various embodiments or components described above, for example, the alarm panel, the central monitoring station, the computing device, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system. As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A method for determining maintenance needs in an alarm system comprising:

receiving, at a central monitoring station, a plurality of operational measurements and a maintenance history related to the alarm system; and predicting a maintenance need of the alarm system by applying one or more maintenance rules to the plurality of operational measurements and the maintenance history.

2. The method of claim 1, further comprising updating the maintenance history based on the predicted maintenance need.

3. The method of claim 1, wherein the determined maintenance need is a first maintenance need, the method further comprising predicting a second maintenance need of the alarm system based at least in part on the plurality of operational measurements and the maintenance history for the alarm system.

4. The method of claim 3, further comprising adding the plurality of operational measurements, the first predicted maintenance need and the second predicted maintenance need to the maintenance history.

5. The method of claim 3, wherein the first maintenance need is required and the second maintenance need is optional.

6. The method of claim 1, further comprising providing a plurality of points of the alarm system, each of the plurality of points corresponding to a module or a device operable with the alarm system.

7. The method of claim 6, wherein the plurality of points are selected from the group consisting of sensors, notification appliances, initiating devices, notification appliances, video and/or audio recording devices, zone expanders, output modules, power suppliers, light controllers, appliance controllers, sounding devices, thermostats, controllable outlets, door locks, power monitors, remotes, liquid valves, and air vents.

8. The method of claim 7, wherein the plurality of operational measurements are selected from the group consisting of a battery level of one or more of the plurality of points, a wireless connectivity level of one or more of the plurality of points, a cellular connectivity level of the alarm system, a measurement of the resistance of one or more of the plurality of points, a measurement of power consumption of one or more of the plurality of points, current or voltage levels of one or more of the plurality of points, amount of operating time of one or more of the plurality of points, a temperature of an environment surrounding one or more of the plurality of points, and fluid characteristics of one or more of the plurality of points.

9. A method for predicting maintenance needs in a security system comprising:

receiving, at a central monitoring station, a plurality of operational measurements and a maintenance history related to a plurality of points of the security system; and predicting a maintenance need of the plurality of points by applying one or more maintenance rules to the plurality of operational measurements and the maintenance history.

10. The method of claim 9, further comprising updating the maintenance history based on the predicted maintenance need.

11. The method of claim 9, wherein the predicted maintenance need is a first maintenance need, the method further comprising predicting a second maintenance need of the security system based at least in part on the plurality of operational measurements and the maintenance history for the plurality of points.

12. The method of claim 11, further comprising adding the plurality of operational measurements, the first predicted maintenance need and the second predicted maintenance need to the maintenance history.

13. The method of claim 11, wherein the maintenance need is at least one of: a software or firmware update for one or more of the plurality of points, and a replacement recommendation for one or more of the plurality of points.

14. The method of claim 9, wherein each of the plurality of points corresponds to a module or a device operable with the security system.

15. The method of claim 9, wherein the plurality of points are selected from the group consisting of sensors, notification appliances, initiating devices, notification appliances, video and/or audio recording devices, zone expanders, output modules, power suppliers, light controllers, appliance controllers, sounding devices, thermostats, controllable outlets, door locks, power monitors, remotes, liquid valves, and air vents.

16. The method of claim 9, wherein the plurality of operational measurements are selected from the group consisting of a battery level of one or more of the plurality of points, a wireless connectivity level of one or more of the plurality of points, a cellular connectivity level of the alarm system, a measurement of the resistance of one or more of the plurality of points, a measurement of power consumption of one or more of the plurality of points, current or voltage levels of one or more of the plurality of points, amount of operating time of one or more of the plurality of points, a temperature of an environment surrounding one or more of the plurality of points, and fluid characteristics of one or more of the plurality of points.

17. A system for predicting maintenance needs of an alarm system comprising:

a connection component configured to receive a plurality of operational measurements from a plurality of points of an alarm system; and a maintenance needs determination module configured to predict a maintenance need of the plurality of points by applying one or more maintenance rules to the plurality of operational measurements and the maintenance history.

18. The system of claim 17, the maintenance needs determination module further configured to update the maintenance history based on the predicted maintenance need.

19. The system of claim 18, wherein the plurality of points are selected from the group consisting of sensors, notification appliances, initiating devices, notification appliances, video and/or audio recording devices, zone expanders, output modules, power supplies, light controllers, appliance controllers, sounding devices, thermostats, controllable outlets, door locks, power monitors, remotes, liquid valves, and air vents.

20. The system of claim 19, wherein the plurality of operational measurements are selected from the group consisting of a battery level of one or more of the plurality of points, a wireless connectivity level of one or more of the plurality of points, a cellular connectivity level of the alarm system, a measurement of the resistance of one or more of the plurality of points, a measurement of power consumption of one or more of the plurality of points, current or voltage levels of one or more of the plurality of points, amount of operating time of one or more of the plurality of points, a temperature of an environment surrounding one or more of the plurality of points, and fluid characteristics of one or more of the plurality of points.

21. The system of claim 17, wherein the maintenance needs determination module predicts the maintenance need to be at least one of: a software or firmware update for one of the plurality of points, and a suggested replacement for one of the plurality of points.

* * * * *